US007290388B2

(12) United States Patent
Kikuchi et al.

(10) Patent No.: US 7,290,388 B2
(45) Date of Patent: Nov. 6, 2007

(54) MOTORCYCLE EXHAUST SYSTEM

(75) Inventors: Hiroyuki Kikuchi, Kobe (JP); Hidehiko Yamamoto, Kobe (JP); Yoji Onishi, Kobe (JP); Naoki Yokoyama, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/222,718

(22) Filed: Sep. 9, 2005

(65) Prior Publication Data

US 2006/0053780 A1 Mar. 16, 2006

(30) Foreign Application Priority Data

Sep. 13, 2004 (JP) ..... 2004-265284

(51) Int. Cl.
*F01N 3/00* (2006.01)

(52) U.S. Cl. ..... 60/323; 60/324

(58) Field of Classification Search ..... 60/299, 60/302, 323, 324
See application file for complete search history.

(56) References Cited

U.S. PATENT DOCUMENTS 4,261,170 A * 4/1981 Suzuki ..... 60/302
5,271,477 A * 12/1993 Gekka et al. ..... 180/219
5,365,735 A * 11/1994 Weber et al. ..... 60/323
5,976,473 A * 11/1999 Reck et al. ..... 422/180
6,609,366 B2 * 8/2003 Kameyama ..... 60/323
6,887,294 B2 * 5/2005 Kanematsu ..... 55/418
2002/0083703 A1 * 7/2002 Werth et al. ..... 60/323
2006/0053782 A1 * 3/2006 Kobayashi et al. ..... 60/302

FOREIGN PATENT DOCUMENTS

JP 2003-307126 10/2003

* cited by examiner

*Primary Examiner*—Thomas Denion
*Assistant Examiner*—Diem Tran

(57) ABSTRACT

A motorcycle exhaust system includes a catalytic converter (43) disposed within an exhaust passage (37) for discharging exhaust gas (G) from a multi-cylinder combustion engine (E) and operable to purify the exhaust gas (G). An upstream end of the catalytic converter (43) has different regions (S1 and S2) communicated with upstream exhaust passage portions (37*a* and 37*a*), respectively, and a downstream end of the catalytic converter (43) is communicated with downstream exhaust passage portions (37*b* and 37*b*) in a number equal to or smaller than the number of the upstream exhaust passage portions (37*a* and 37*a*). Also, the catalytic converter (43) has a partition wall (43*c*) extending in a direction of flow of the exhaust gas (G) for allowing the exhaust gas (G) from the upstream exhaust passage portions (37*a* and 37*a*) to flow through the catalytic converter (43) without being mixed together.

17 Claims, 8 Drawing Sheets

MOTORCYCLE EXHAUST SYSTEM

BACKGROUND OF THE INVENTION

1. Field of the Invention

The present invention relates to an exhaust system mounted on a motorcycle for purifying exhaust gas emitted from a motorcycle combustion engine and for discharging the purified exhaust gas.

2. Description of the Prior Art

It is known that exhaust gas emitted from the motorcycle combustion engine have hitherto been discharged to the atmosphere after having been purified with a catalytic converter disposed on an exhaust passage. In this known exhaust gas purifying system, the exhaust gas tend to be introduced into the catalytic converter in a condition with its temperature somewhat lowered during the flow through the exhaust passage. Accordingly, immediately after the cold start of the combustion engine, a substantial amount of time is required for the catalyst to be activated to initiate oxidization reaction within the catalytic converter and, therefore, it may often occur that a sufficient purifying function does not take place.

In view of the foregoing, in order for the catalyst to be activated to initiate the oxidization reaction immediately after the cold start of the combustion engine, an exhaust gas purifying system is suggested, in which the catalytic converter is disposed in an upstream portion of the exhaust passage with respect to the direction of flow of the exhaust gas towards the atmosphere. See, for example, the Japanese Laid-open Patent Publication No. 2003-307126.

However, it has been found that if the catalytic converter is disposed in the upstream portion of the exhaust passage, the catalyst converter will have to be disposed inside each of a plurality of exhaust pipes connected to respective engine cylinders, resulting in complication of the structure and increase of the cost. By way of example, in the case of the four-cylinder combustion engine having four upstream exhaust pipes, generally known as header pipes or downpipes, every two upstream exhaust pipes are merged together to provide two intermediate exhaust pipes, which are then merged into a single downstream exhaust pipe. In this merged-pipe system, if the catalytic converter is disposed in the relatively upstream portion of the exhaust passage where the intermediate exhaust pipes are positioned, the total number of the catalytic converters required will be two and those two catalytic converters will be positioned in a lower region of an oil pan at the bottom of the combustion engine.

Considering that in mounting the two catalytic converters in that upstream portion of the exhaust passage, disposition of the two catalytic converters in forward and rearward displaced relation to each other with respect to the longitudinal direction of the exhaust passage will result in unbalanced outputs between the engine cylinders and, therefore, in an attempt to avoid the unbalanced outputs, the two catalytic converters are generally arranged left and right. This arrangement leads to increase of the widthwise space for accommodating those catalytic converters, thus limiting the capacity of the oil pan.

If the two intermediate exhaust pipes are merged into the single downstream pipe at a location, where the same catalytic converters are disposed, and the only catalytic converter is employed rather than the two, problems associated with complication of the structure, high cost and the limitation of the capacity of the oil pan may be eliminated. However, since the two exhaust pipes, into which the four exhaust pipes coming out of the respective engine cylinder are merged, terminate at a location upstream of the catalytic converter and thus have a relatively small length, the engine output characteristic will vary and, in particular, vary at a medium speed region of the combustion engine.

SUMMARY OF THE INVENTION

In view of the foregoing, the present invention has been devised to substantially eliminate the problems and inconveniences inherent in the prior art exhaust systems and is intended to provide an improved exhaust system for a motorcycle, in which the number of catalytic converters used is reduced to simplify the structure and to reduce the cost and in which a catalytic converter can be disposed at a proper location to set the engine characteristic as desired.

In order to accomplish the foregoing object, the present invention provides a motorcycle exhaust system which includes a catalytic converter disposed within an exhaust passage for discharging exhaust gas from a multi-cylinder combustion engine and operable to purify the exhaust gas. In this motorcycle exhaust system, an upstream end of the catalytic converter has different regions communicated with a plurality of upstream exhaust passage portions of the exhaust passage, respectively, and a downstream end of the catalytic converter is communicated with downstream exhaust passage portion or portions of the exhaust passage in a number equal to or smaller than the number of the upstream exhaust passage portions. Also, the catalytic converter has a partition wall extending in a direction conforming to a direction of flow of the exhaust gas for allowing the exhaust gas from the upstream exhaust passage portions of the exhaust passage to flow through the catalytic converter without being mixed together.

According to the present invention, since the partition wall of the catalytic converter allows the exhaust gas to flow from the upstream exhaust passage portions through the catalytic converter without being mixed together, the upstream exhaust passage portions can be substantially extended to the inside of the catalytic converter. Accordingly, the catalytic converter can be positioned relatively upstream in the exhaust passage and close to the combustion engine within the exhaust passage, so that immediately after the cold start of the combustion engine, the catalyst can be activated to purify the exhaust gas and, also, the upstream exhaust passage portions can have a substantially increased length sufficient to allow the combustion engine to exhibit a desired engine characteristic. Also, since the only one catalytic converter is sufficient for the plural upstream exhaust passage portions, the number of catalytic converters required can advantageously be reduced to thereby simplify the structure and also to reduce the cost.

In a preferred embodiment of the present invention, on at least one of upstream and downstream sides of the catalytic converter, a partition plate may be provided within an exhaust pipe, forming a part of the exhaust passage, so as to extend in the direction of flow of the exhaust gas. This partition plate is to be used for laterally dividing the exhaust passage. This is particularly advantageous in that the length of the upstream exhaust passage portions or the downstream exhaust passage portions can easily be adjusted.

In another preferred embodiment of the present invention, a sealing member may be disposed in between an outer peripheral surface of the catalytic converter and an inner peripheral surface of the exhaust passage for avoiding a communication between the upstream or downstream exhaust passage portions outside the catalytic converter. When the catalytic converter is fitted to the inner peripheral surface of the exhaust passage through, for example, a bracket, a gap is formed between the catalytic converter and the exhaust passage. However, the use of the sealing member is particularly advantageous in that a free communication between the upstream exhaust passage portions or between the downstream exhaust passage portions outside the catalytic converter can be effectively avoided so that the exhaust gas from the upstream exhaust passage portions can flow through the catalytic converter without being mixed together.

In a further preferred embodiment of the present invention, the motorcycle exhaust system may include four upstream exhaust pipes connected to the combustion engine of a four-cylinder, two intermediate exhaust pipes each fluidly connected with respective downstream ends of two of the four upstream exhaust pipes, a single exhaust assemblage pipe fluidly connected with respective downstream ends of the two intermediate exhaust pipes. In this case, the catalytic converter and at least one of the partition plates on the upstream and downstream sides of the catalytic converter are disposed within the single exhaust assemblage pipe. This arrangement is particularly advantageous in that in the exhaust system including the exhaust passage of a structure in which four upstream exhaust pipes coming out of the four-cylinder combustion engine are merged into two intermediate exhaust pipes, which are in turn merged into a single downstream exhaust assemblage pipe, the presence of the partition wall in the catalytic converter and the partition plate located upstream or downstream of the catalytic converter allows the two intermediate exhaust pipes to be substantially extended and, therefore, the engine output at the medium speed region of the combustion engine can be increased.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
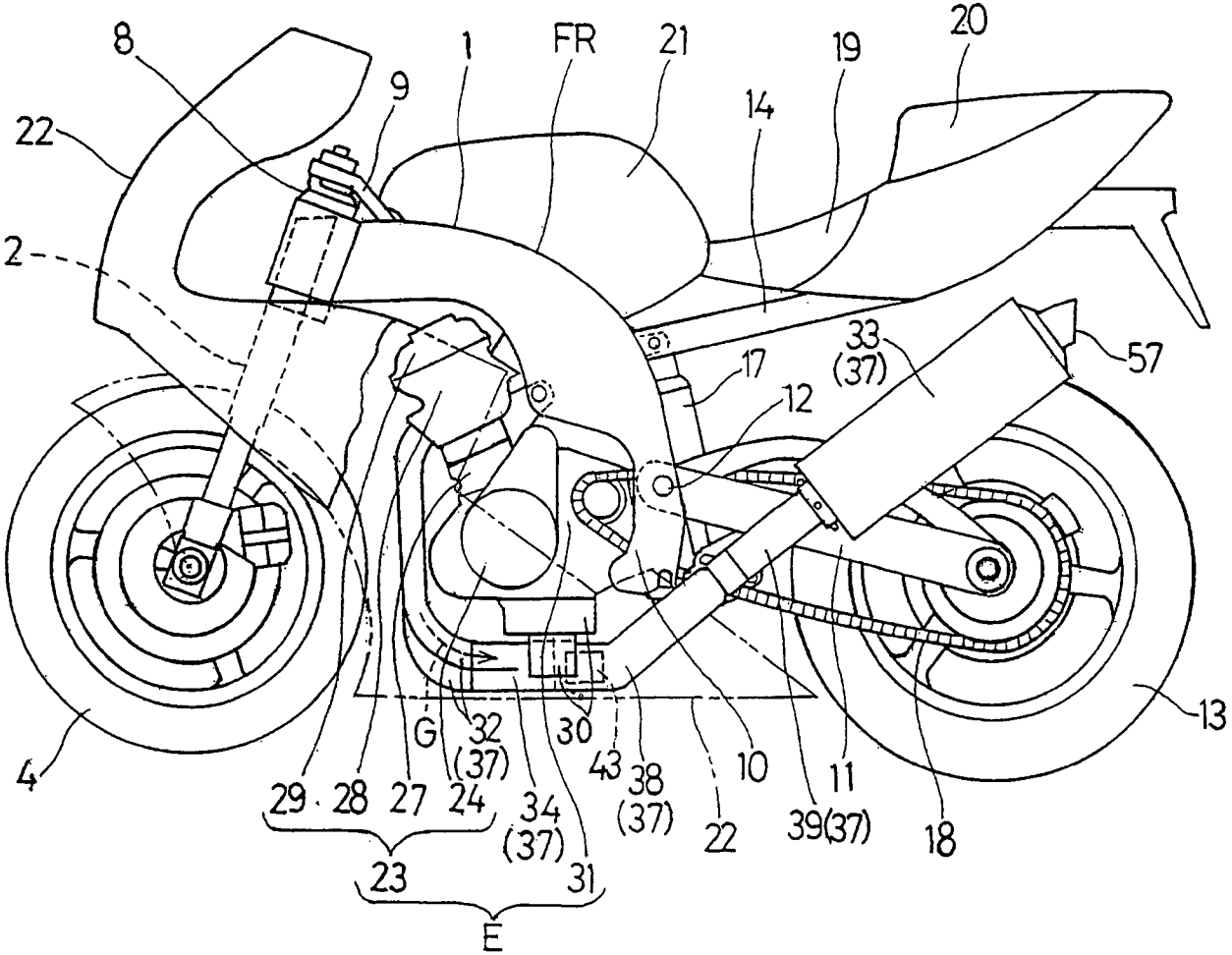
FIG. 1 is a side view of a motorcycle equipped with an exhaust system according to a first preferred embodiment of the present invention.

Hereinafter, preferred embodiments of the present invention will be described in detail with reference to the accompanying drawings. In particular, FIG. 1 is a side view of a motorcycle equipped with an exhaust system according to a first preferred embodiment of the present invention. The motorcycle shown therein includes a motorcycle frame structure FR having a main frame 1 forming a front part of the motorcycle frame structure FR. A front fork assembly 2 is rotatably supported by a front end of the main frame 1 and carries a front wheel 4 at a lower end of the front fork assembly 2. A handlebar 9 is fixedly connected with an upper bracket 8 that supports an upper end of the front fork assembly 2.

Swingarm brackets 10 are provided at a rear lower portion of the main frame 1, and a swingarm 11 is connected at a front end thereof with the swingarm brackets 10 through a pivot shaft 12 for pivotal movement up and down. A rear drive wheel 13 is rotatably supported by the swingarm 11. Seat rails 14 connected with a rear portion of the main frame 1 form a rear part of the motorcycle frame structure FR. A rear suspension unit 17 for cushioning the rear drive wheel 13 is interposed between the main frame 1 and the swingarm 11. A combustion engine E is mounted on a generally intermediate portion of the main frame 1 and is drivingly connected with the rear drive wheel 13 through a chain 18.

A rider seat 19 and a fellow passenger seat 20 are supported on the seat rails 14, and a fuel tank 21 is mounted on the main frame 1 between the handlebar 9 and the rider seat 19. A fairing or cowling 22 made of a synthetic resin is mounted on a front portion of the motorcycle frame structure FR so as to cover a region of the motorcycle frame structure FR ranging from the front portion of the motorcycle forwardly of the handlebar 9 to left and right lateral portions thereof. The fairing or cowling 22 has lateral rear portions covering lateral portions of the combustion engine E.

The combustion engine E discussed above is a four-cylinder, four-stroke combustion engine and includes an engine body 23, having a crankcase 24, a cylinder block 27, a cylinder head 28, a cylinder head cover 29 and an oil pan 30, and a transmission 31. An exhaust passage 37 for the combustion engine E includes four upstream exhaust pipes 32, a single downstream exhaust assemblage pipe 38, and two intermediate exhaust pipes 34 each intervening between two of the four upstream exhaust pipes 32 and the single exhaust assemblage pipe 38. Each of the upstream exhaust pipes 32 is connected to the respective cylinder head 28 for flowing an exhaust gas G out of the cylinder head 28, and every two of the upstream exhaust pipes 32 are merged at their downstream ends into the corresponding intermediate exhaust pipe 34. The intermediate exhaust pipes 34 are then merged at their downstream ends into the single downstream exhaust assemblage pipe 38. The single downstream exhaust assemblage pipe 38 has a downstream end fluidly connected with a muffler 33 through a coupling tube 39. The four upstream exhaust pipes 32, the two intermediate exhaust pipes 34, the single downstream exhaust assemblage pipe 38, the coupling tube 39 and the muffler 33 form the exhaust passage 37 of the exhaust system. As will become clear from the subsequent description, the exhaust assemblage pipe 38 has a catalytic converter 43 incorporated therein.

Figure 2:
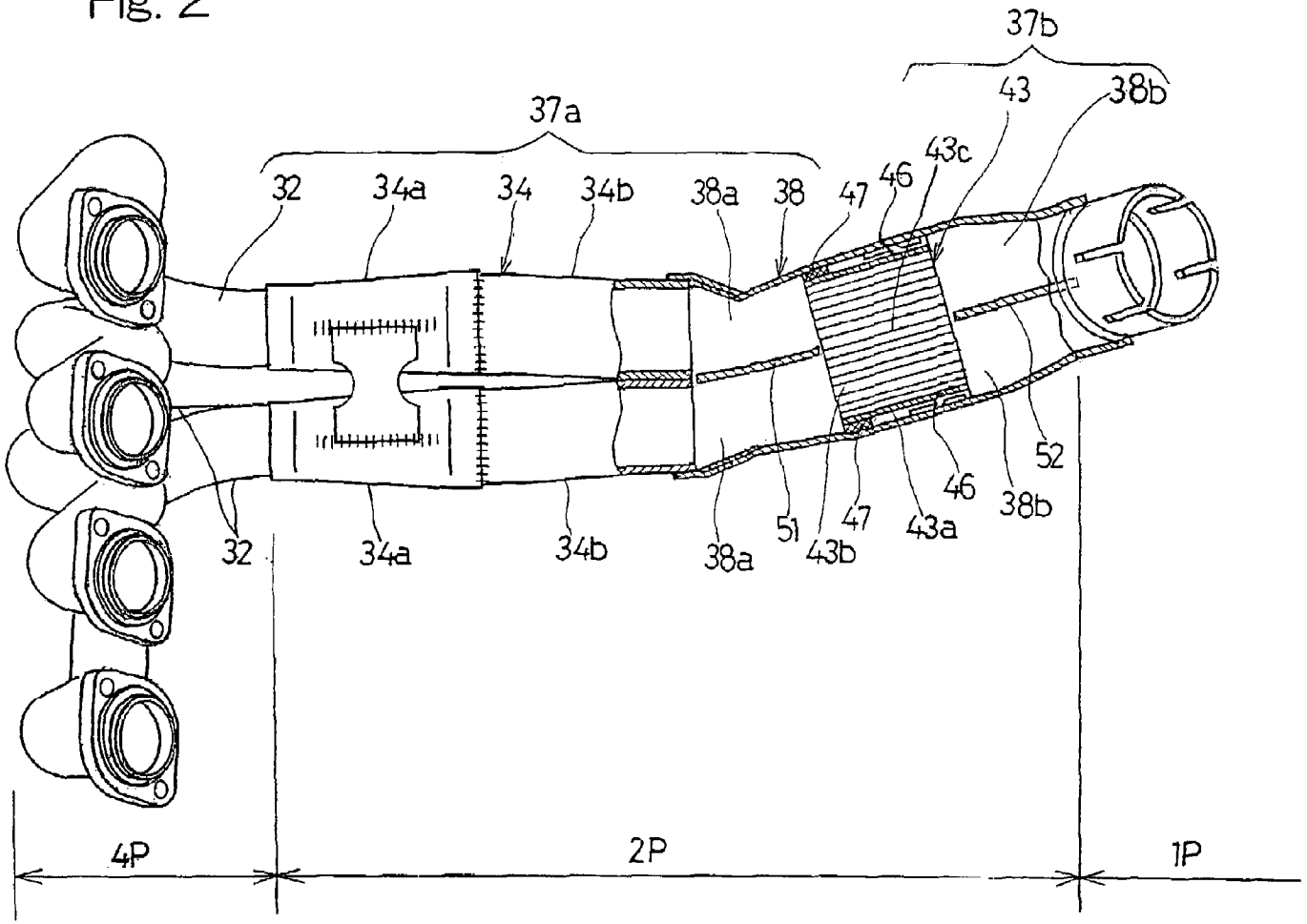
FIG. 2 is a plan view, with a portion cut out, of the exhaust system shown in FIG. 1.

FIG. 2 illustrates a plan view, with a portion cut out, of the exhaust system shown in FIG. 1. In the exhaust passage 37 of the combustion engine E of a four-cylinder, every two of the four upstream exhaust pipes 32 defining a four-flow-path region 4P are merged together to provide two exhaust flow paths, which are in turn merged into one exhaust flow path. The exhaust passage system 37 extends from upstream to downstream through the four-flow-path region 4P, then through a two-flow-path region 2P and finally through one-flow-path region 1P. The two-flow-path region 2P is defined by the two intermediate exhaust pipes 34 and an upstream portion of the single downstream exhaust assemblage pipe 38, which are divided into two flow paths by partition walls 51 and 52 hereinafter described. More specifically, every two of the upstream exhaust pipes 32 are merged together to provide the two exhaust flow paths (the region 2P) through forked passageways 34*a* and a merging passageway 34*b* of the corresponding intermediate exhaust pipe 34. The two exhaust flow paths (the region 2P) are in turn merged into the single exhaust flow path (the region 1P) through the single downstream exhaust assemblage pipe 38 that are fluidly connected with the two intermediate exhaust pipes 34.

Thus, in the case of the four-cylinder combustion engine such as in the illustrated embodiment, the two flow paths region 2P extends a relatively great distance to allow the combustion engine to provide an increased engine output at a medium speed region of the combustion engine.

Figure 3A:
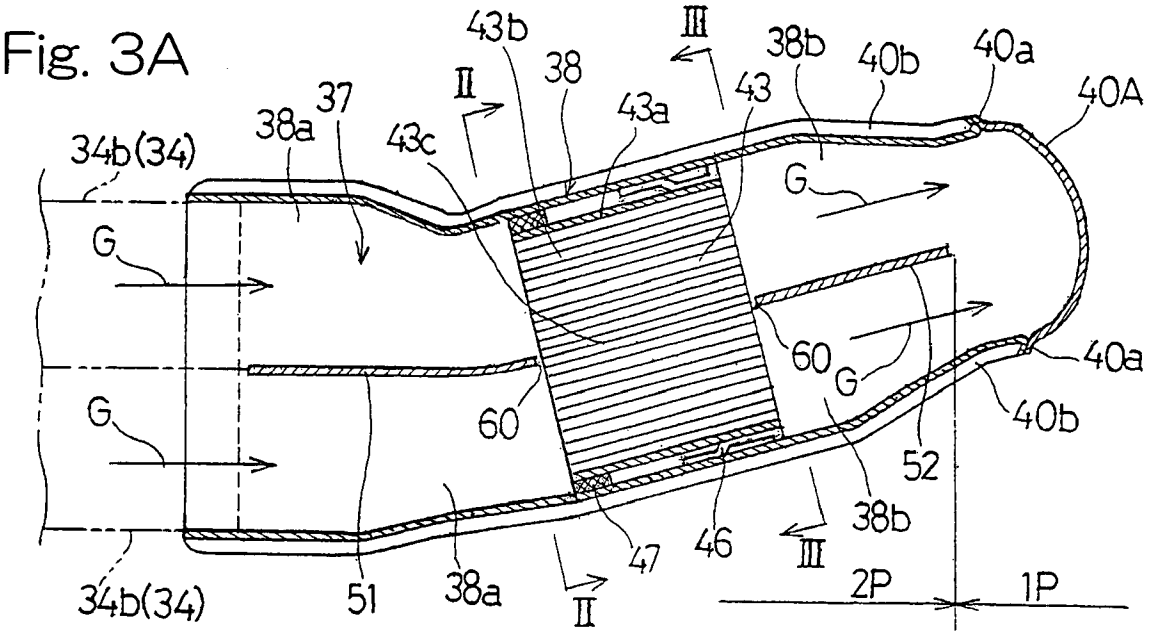
FIG. 3A is an enlarged plan view, with a portion cut out, of an important portion of the exhaust system shown in FIG. 1.

FIG. 3A illustrates a fragmentary plan view, on an enlarged scale, of an important portion of the exhaust system shown in FIG. 1. The downstream exhaust pipe 38 forming a part of the exhaust passage 37 has a catalytic converter 43 accommodated in a generally intermediate portion thereof. The downstream exhaust pipe 38 has an upstream portion on an upstream side of the catalytic converter 43, which is divided by a partition plate 51 into two parallel introducing passage portions 38*a* and 38*a*. This downstream exhaust pipe 38 also has a downstream portion on a downstream side of the catalytic converter 43, which is similarly divided by a partition plate 52 into two parallel discharging passage portions 38*b* and 38*b*. Specifically, the partition plates 51 and 52 extend within the downstream exhaust pipe 38 in a direction parallel to the direction of flow of the exhaust gas G, with the parallel introducing passage portions 38*a* and 38*a* defined on respective sides of the partition plate 51 in the upstream portion thereof and, also, with the parallel discharging passage portions 38*b* and 38*b* defined on respective sides of the partition plate 52 in the downstream portion thereof.

The catalytic converter 43 is of a structure having a cylindrical catalyst carrier block encased within a substantially cylindrical casing 43*a*. This cylindrical casing 43*a* has a bracket 46 in the form of, for example, a weldable plate fixed on an outer peripheral surface thereof. The catalytic converter 43 is fixed inside the downstream exhaust pipe 38 with the bracket 46 welded to an inner peripheral surface of the downstream exhaust pipe 38.

In this way, as shown in FIG. 2, the upstream exhaust pipes 32, the intermediate exhaust pipe 34 and the upstream portion of the downstream exhaust assemblage pipe 38 altogether form an upstream exhaust sub-passage 37*a* that is communicated with an upstream end of the catalytic converter 43 and, on the other hand, the downstream portion of the downstream exhaust assemblage pipe 38, the coupling tube 39 (FIG. 1) and the muffler 33 (FIG. 1) altogether form the downstream exhaust sub-passage 37*b* that is communicated with a downstream end of the catalytic converter 43.

Figure 3C:
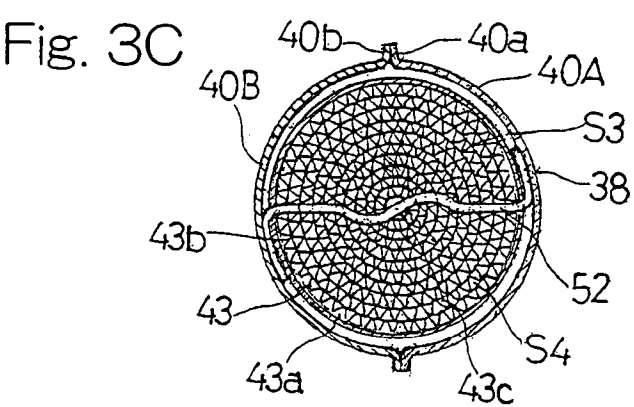
FIG. 3C is a cross-sectional view taken along the line III-III in FIG. 3A.
Figure 3B:
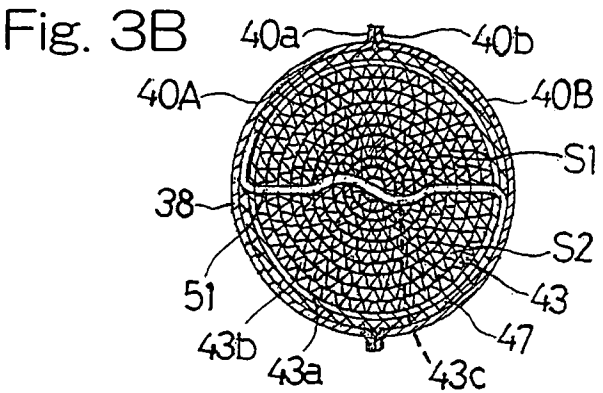
FIG. 3B is a cross-sectional view taken along the line II-II in FIG. 3A.

The downstream exhaust assemblage pipe 38 is of a structure including, as shown in FIG. 3B, a pair of substantially semicircular-sectioned plates 40A and 40B connected together to render the downstream exhaust assemblage pipe 38 to represent a substantially cylindrical configuration with the catalytic converter 43 immovably positioned inside. Specifically, each of the semicircular-sectioned plates 40A and 40B is formed integrally with a pair of ears 40*a* or 40*b* protruding radially outwardly of the exhaust assemblage pipe 38 in respective directions opposite to each other. The ears 40*a* of the semicircular-sectioned plate 40A are firmly jointed with the ears 40*b* of the semicircular-sectioned plate 40B, respectively, by welding to complete the downstream exhaust assemblage pipe 38. Prior to the semicircular-sectioned plates 40A and 40B being connected by welding, an annular sealing member 47 prepared from stainless wool or water-resistant glass wool is mounted on an outer peripheral surface of an upstream end of the casing 43 accommodating the catalytic converter 43 therein.

The cylindrical catalyst carrier block within the casing 43*a* of the catalytic converter 43 is of a honeycomb structure of a substantially round-sectioned configuration having a multiplicity of pores arranged circumferentially and radially thereof, which pores are left by alternately laminating a plurality of annular flat plates and annular corrugated plates of a ceramic material. The flat plates and the corrugated plates, both forming respective parts of the catalyst carrier block, contain a catalyst 43*b* such as platinum or rhodium baked thereto. It is to be noted that the catalyst carrier block may have a substantially oval-sectioned configuration.

The honeycomb-structured catalyst carrier block of the catalytic converter 43 is disposed within the casing 43*a* with its longitudinal axis aligned with the direction of flow of the exhaust gas G, that is, with the pores oriented in a direction conforming to the direction of flow of the exhaust gas G. Respective portions of the flat plates and the corrugated plates, which are adjacent a downstream end of the partition plate 51 extend in the direction of flow of the exhaust gas G so as to serve as a partition wall 43*c* effective to allow the exhaust gas G flowing from the respective introducing passage portions 38*a* and 38*a* to flow in a downstream direction without being mixed together.

The two introducing passage portions 38*a* and 38*a* have their downstream end portions separated from each other by the partition plate 51 and are communicated respectively with two regions S1 and S2 of an upstream end face of the catalytic converter 43 that are divided by the partition wall 43*c*, as shown in FIG. 3B. Similarly, the two discharging passage portions 38*b* and 38*b* have their upstream end portions separated from each other by the partition plate 52 and are communicated respectively with two regions S3 and S4 of a downstream end face of the catalytic converter 43 that are divided by the partition wall 43*c*, as shown in FIG. 3C. As shown in FIGS. 3B and 3C, respective radially intermediate portions of the partition plates 51 and 52 have a transverse sectional shape lying perpendicular to the direction of flow of the exhaust gas G, which represents a substantially corrugated shape. It is to be noted that the corrugated portion in each of the partition plates 51 and 52 may be provided at a location offset from the radial intermediate portion thereof towards a radial end thereof.

The reason for providing the partition plate 51 and 52 of the corrugated transverse sectional shape is that, if each of the partition plates 51 and 52 were to have a straight transverse sectional shape, stresses brought about by a bending induced as a result of thermal expansion will concentrate on the radial intermediate portion and, therefore, the corrugated transverse sectional shape is effective to accommodate the stress concentration. Also, the presence of the corrugation in that radial intermediate portion of each of the partition plates 51 and 52 is particularly advantageous in that even though deformation may occur as a result of thermal expansion, that radial intermediate portion can restore to the original shape as the temperature lowers.

Each of the downstream exhaust assemblage pipe 38 and the partition plates 51 and 52 is made of a stainless steel, while the catalytic converter 43 is made of a chromium alloy (for example, 20Cr-5Al) or a ceramic material. In consideration of the difference between the thermal expansion coefficients of those materials, small gaps 60 and 60 are provided between the partition plate 51 and the catalytic converter 43 and between the partition plate 52 and the catalytic converter 43, respectively. By way of example, assuming that the catalytic converter has a size of 70 mm in diameter and 60 mm in length, each of the gaps 60 and 60 is set to have a size not greater than 3 mm at an operating temperature of 250° C. Since the gaps 60 and 60 are reduced in size during an operating condition of the exhaust system, communication between the respective downstream ends of the two introducing passage portions 38*a* and 38*a* and that between the respective upstream ends of the two discharging passage portions 38*b* and 38*b* can be suppressed.

The annular sealing member 47 prepared from stainless wool or water-resistant glass wool is disposed within a gap delimited between the outer peripheral surface of the upstream end of the casing 43*a* of the catalytic converter 43 shown in FIG. 3A and an inner peripheral surface of the downstream exhaust assemblage pipe 38 forming a part of the exhaust passage 37. The presence of the annular sealing member 47 is effective to avoid a free communication between the two introducing passage portions 38*a* and 38*a* in a region outside the casing 43*a*. It is to be noted that the catalytic converter 43 may not have the casing 43*a*, in which case the annular sealing member 47 is mounted directly onto an outer peripheral surface of the catalyst carrier block of the catalytic converter 43.

On the other hand, the presence of the bracket 46 fixed on an outer peripheral surface of a downstream end of the casing 43*a* is effective to avoid a free communication between the two discharging passage portions 38*b* and 38*b* in a region outside the casing 43*a*. Accordingly, even though the catalytic converter 43 is positioned relatively upstream in the exhaust passage 37 and close to the combustion engine E, the two flow paths region 2P of the exhaust passage 37 is formed to extend from the intermediate exhaust pipe 34 to a downstream end of the partition plate 52 through the partition plate 51 and the catalytic converter 43 both within the exhaust assemblage pipe 38, increasing the engine output at the medium speed region of the combustion engine E.

Figure 4:
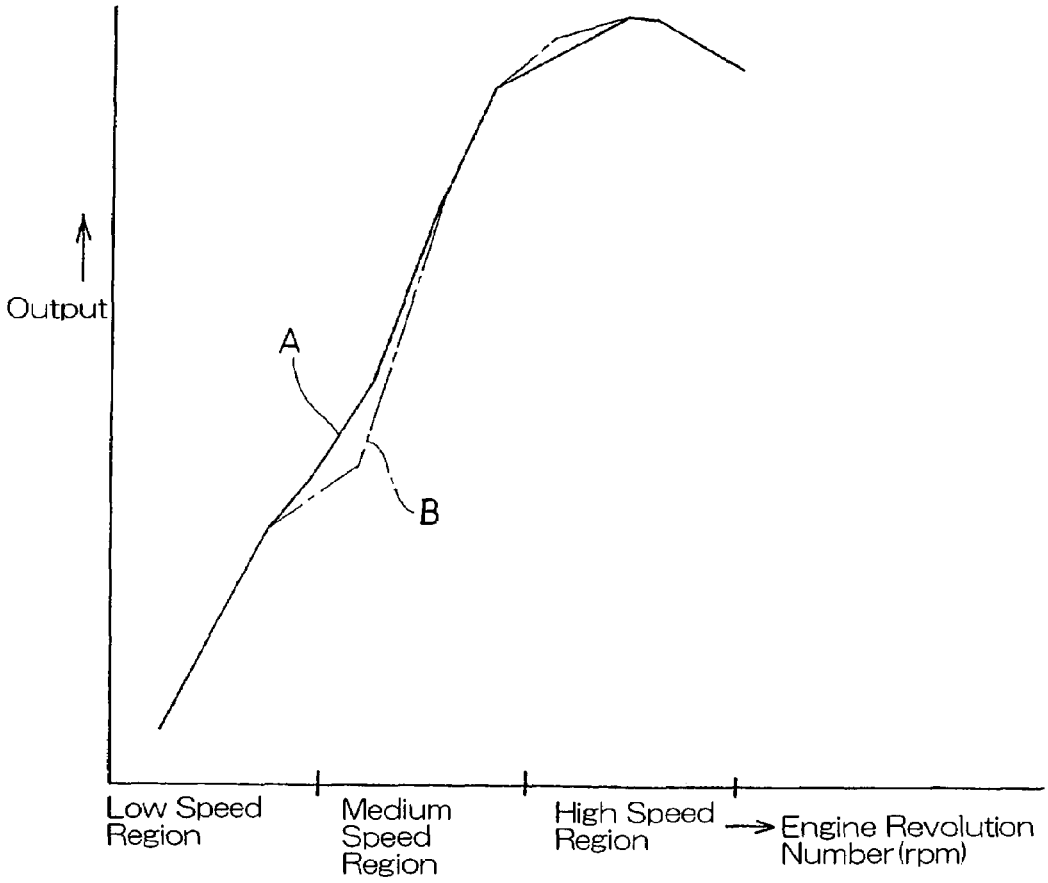
FIG. 4 is a chart showing the relation between the number of revolutions of the combustion engine, which employs the exhaust system according to the first embodiment of the present invention, and the engine output.

The relation between the number of revolutions of the combustion engine E and the engine output is illustrated in FIG. 4. In the chart shown in FIG. 4, comparison is made between the exhaust system A of the first embodiment in which the upstream partition plate 51 is set to have, for example, 80 mm in length and the downstream partition plate 52 is set to have, for example, 60 mm in length, both as measured along the longitudinal axis of the exhaust passage 37, are employed, and the exhaust system B in which neither the upstream partition plate 51 nor the downstream partition plate 52 is employed. The chart shown in FIG. 4 makes it clear that the use of the exhaust system A has resulted in increase of the engine output at the medium speed region. This is because the two flow paths region 2P of the exhaust passage 37 of the exhaust system B terminates at the downstream ends of the intermediate exhaust pipes 34 and is therefore shorter than that in the exhaust system A.

Also, in the first embodiment, since the catalytic converter 43 is disposed relatively upstream in the exhaust passage 37 and close to the combustion engine E, the catalyst 43*b* can be activated immediately after the cold start of the combustion engine E to purify the exhaust gas G. In addition, the use of the single catalytic converter 43 for the two introducing passage portions 38*a* is sufficient in the practice of the present invention and, therefore, the number of catalytic converts required can advantageously be reduced to thereby simplify the structure and also to reduce the cost.

It is to be noted that although in the first embodiment the partition plates 51 and 52 are employed within the downstream exhaust assemblage pipe 38 at the respective locations upstream and downstream of the catalytic converter 43, the downstream partition plate 52 may be, in dependence on the engine performance, dispensed with to provide a single discharging passage portion, so that two partitioned exhaust passage portions within the downstream exhaust assemblage pipe 38 can terminate at the downstream end of the catalytic converter 43.

Figure 5A:
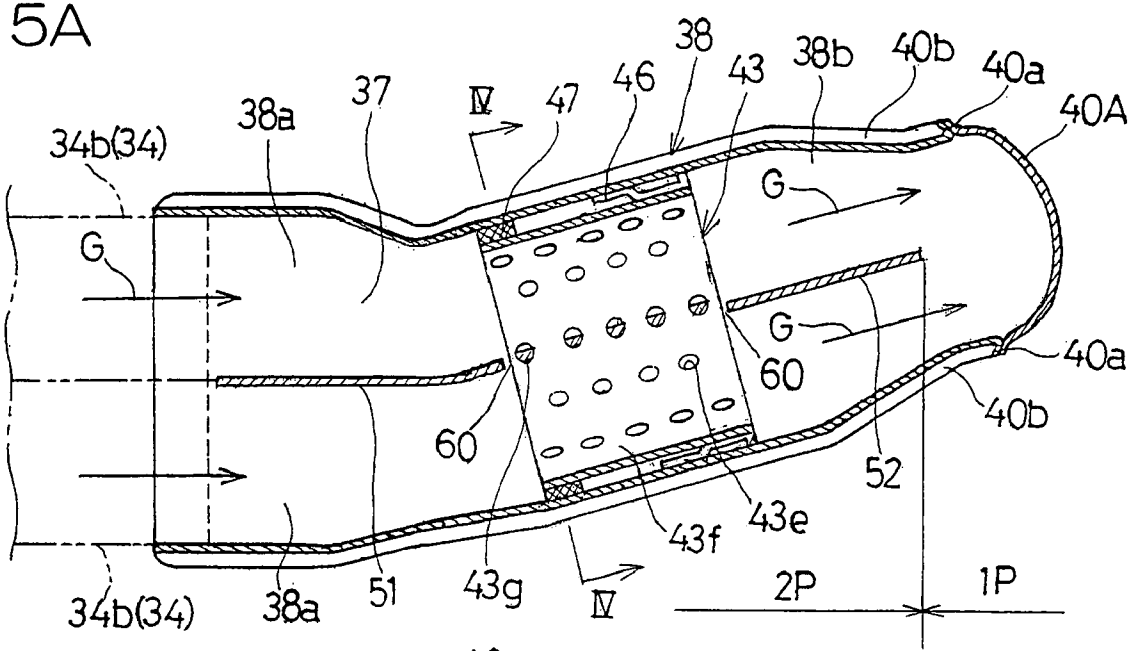
FIG. 5A is a plan view, with a portion cut out, of an essential portion of the exhaust system according to a second preferred embodiment of the present invention.
Figure 5B:
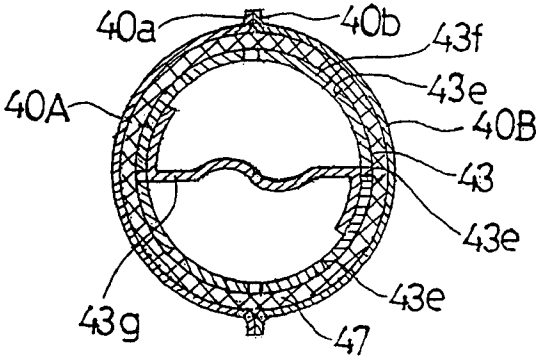
FIG. 5B is a cross-sectional view taken along the line IV-IV in FIG. 5A.

Referring to FIGS. 5A and 5B, the motorcycle exhaust system according to a second preferred embodiment of the present invention is shown. This exhaust system is substantially similar to that according to the first embodiment of FIGS. 2 to 4, but differs therefrom in respect of the details of the catalytic converter 43.

Specifically, although in the first embodiment the catalytic converter 43 is of the honeycomb structure, the catalytic converter 43 of the second embodiment is of a tubular structure, for example, a circular cylinder or oval cylinder, including a tubular body 43*f* in the form of a stainless-steel perforated plate having a plurality of fine perforations 43*e* left by punching the stainless steel plate. This tubular body 43*f* carries a catalyst 43*b*, for example, platinum or rhodium deposited on surfaces thereof. A partition wall 43*g* is fixed inside the tubular body 43*f* by welding.

Figure 6A:
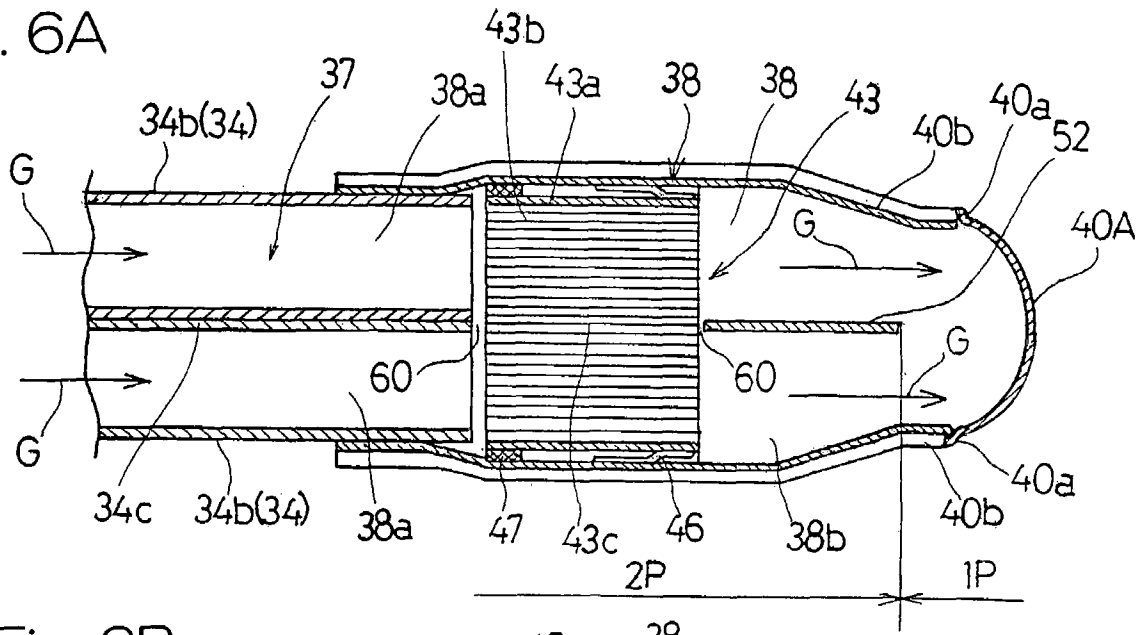
FIG. 6A is an enlarged plan view, with a portion cut out, of an important portion of the exhaust system according to a third preferred embodiment of the present invention.
Figure 6B:
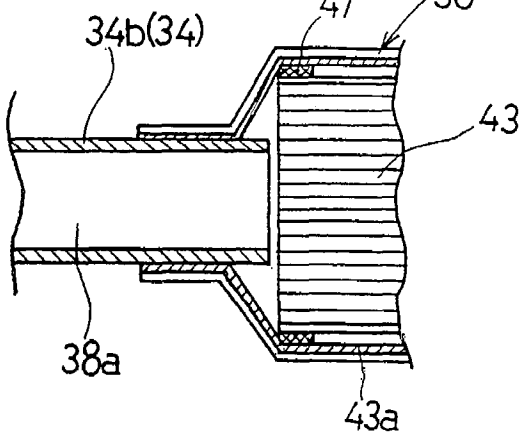
FIG. 6B is an enlarged side showing that essential portion of the exhaust system shown in FIG. 6A.

The motorcycle exhaust system according to a third preferred embodiment of the present invention will now be described. Referring to FIGS. 6A and 6B, which illustrate a plan view and a fragmentary side sectional view, both on an enlarged scale, of an important portion of the exhaust system according to the third embodiment of the present invention, respectively, the upstream partition plate, which has been shown by 51 as disposed upstream of the catalytic converter 43 in any one of the foregoing embodiments, is not employed and, instead, the intermediate exhaust pipes 34 are extended so as to have their downstream ends terminating in the vicinity of the upstream end of the catalytic converter 43 within the exhaust assemblage pipe 38. In this arrangement, a portion of the catalytic converter, which is adjacent a downstream end of a jointed wall 34*c* of the intermediate exhaust pipes 34, serves as a partition wall 43*c*.

Also, since each of the intermediate exhaust pipes 34 is made of a stainless steel and the catalytic converter 43 of the honeycomb structure is made of a ceramic material, in consideration of the difference between the of thermal expansion coefficients of those materials, small gaps 60 and 60 are provided between the downstream ends of the intermediate exhaust pipes 34 and the upstream end of the catalytic converter 43 and between the downstream end of the catalytic converter 43 and the upstream end of the downstream partition plate 52, respectively, as is the case with the first embodiment. Accordingly, the exhaust gas G flowing from the respective introducing passage portions 38*a* and 38*a* can be prevented by the partition wall 43*c* from being mixed together within the catalytic converter 43 and, therefore, the two flow paths region 2P of the exhaust passage 37 can be substantially extended to the downstream end of the partition plate 52 beyond the catalytic converter 43.

It is to be noted that in the third embodiment of FIGS. 6A and 6B, the downstream partition plate 52 may be, in dependence on the engine performance, dispensed with to provide a single discharging passage portion 38*b*, so that the two flow paths region 2P of the exhaust passage 37 terminates at the downstream end of the catalytic converter 43.

Figure 7:
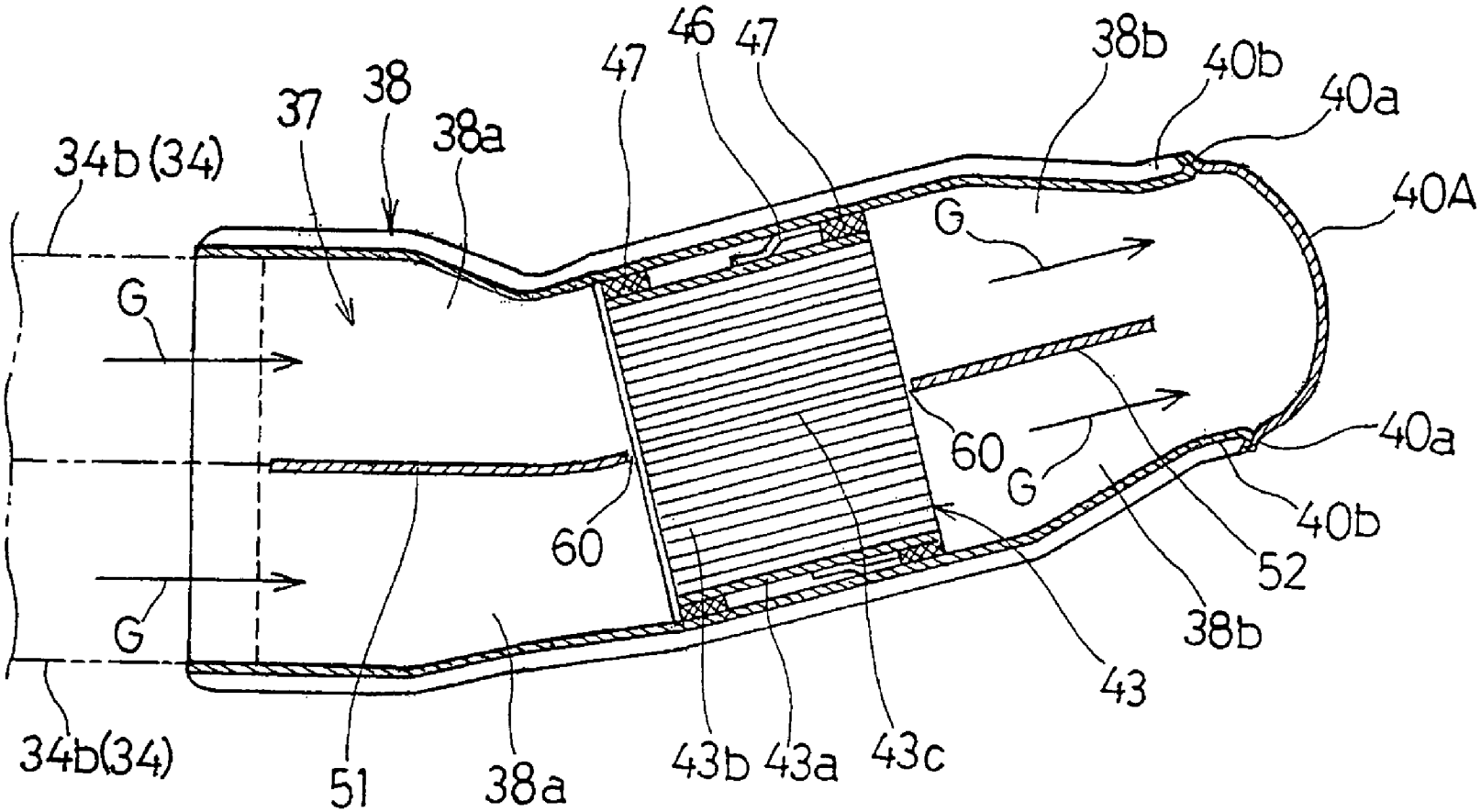
FIG. 7 is an enlarged plan view, with a portion cut out, of an essential portion of the exhaust system according to a fourth preferred embodiment of the present invention.
Figure 8:
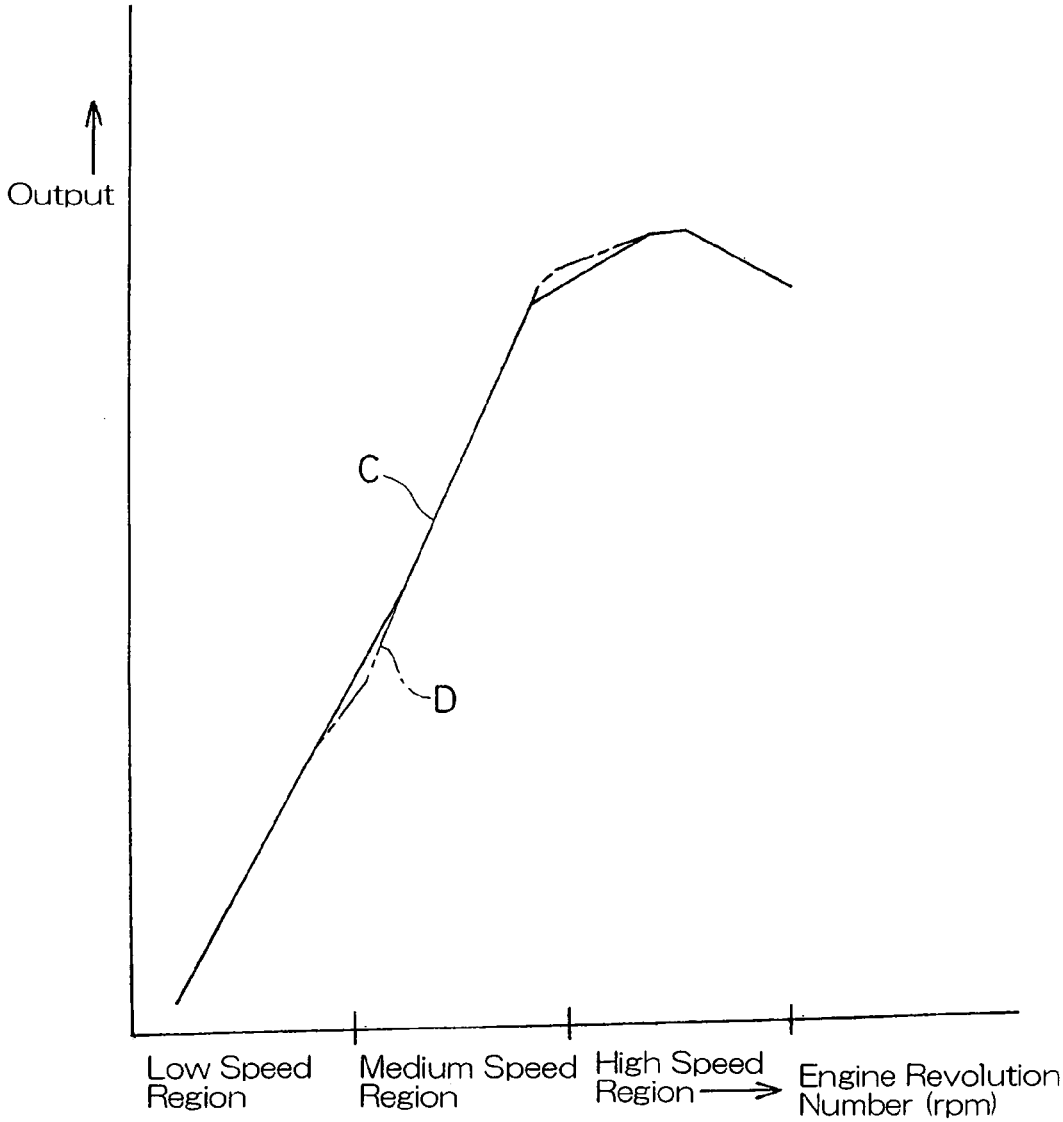
FIG. 8 is a chart showing the relation between the number of revolutions of the combustion engine, which employs the exhaust system according to the fourth embodiment of the present invention, and the engine output.

Reference is now made to FIGS. 7 and 8 for the detailed description of the motorcycle exhaust system according to a fourth preferred embodiment of the present invention. As shown in FIG. 7, two annular sealing members 47 and 47 are packed in respective gaps one between the upstream end of the casing 43*a* of the catalytic converter 43 and the inner peripheral surface of the upstream exhaust assemblage pipe 38 and the other between the downstream end of the casing 43*a* and the inner peripheral surface of the downstream exhaust assemblage pipe 38. Each of those sealing members 47 is prepared from stainless wool or water-resistant glass wool. Those sealing members 47 and 47 are effective to avoid a free communication between the two introducing passage portions 38*a* and 38*a* in a region outside the casing 43*a* and a free communication between the two discharging passage portions 38*b* and 38*b* in a region outside the casing 43. Thus, it will readily be seen that the two flow paths region 2P of the exhaust passage system 37 can be substantially extended to the downstream end of the partition plate 52, so that the engine output at the medium speed region of the combustion engine E can be increased.

The relation between the number of revolutions of the combustion engine E, employing the exhaust system according to the fourth embodiment shown in FIG. 7, and the engine output is illustrated in FIG. 8. In the chart shown in FIG. 4, comparison is made between the exhaust system C, in which the two annular sealing members 47 and 47 are employed, and the exhaust system D in which none of the sealing members 47 and 47 is employed. The chart shown in FIG. 8 makes it clear that the exhaust system C has exhibited a higher increase of the engine output at the medium speed region than that exhibited by the exhaust system D.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in any one of the foregoing embodiments of the present invention, only one catalytic converter 43 has been shown and described as employed within the single downstream exhaust assemblage pipe 38, the catalytic converter 43 may be disposed within each of the two intermediate exhaust pipes 34 at a location closer to the combustion engine E than disposed within the exhaust assemblage pipe 38. By disposing the catalytic converter within a merging portion, where the four pipes are merged into one pipe and disposing in the assemblage portion the partition wall, dividing the exhaust pipes into two at a location upstream and downstream of the catalytic converter 43, the four pipes can be merged into two pipes.

Accordingly, such changes and modifications are, unless they depart from the scope of the present invention as delivered from the claims annexed hereto, to be construed as included therein.

What is claimed is:

1. A motorcycle exhaust system which comprises:

a catalytic converter disposed within an exhaust passage for discharging exhaust gas from a multi-cylinder combustion engine and operable to purify the exhaust gas; and a partition plate provided on at least one of upstream and downstream sides of the catalytic converter within an exhaust pipe, forming a part of the exhaust passage, so as to extend in the direction of flow of the exhaust gas, the partition plate dividing the exhaust passage laterally;

wherein an upstream end of the catalytic converter has different regions communicated with a plurality of upstream exhaust passage portions of the exhaust passage, respectively, and a downstream end of the catalytic converter is communicated with downstream exhaust passage portion or portions of the exhaust passage in a number equal to or smaller than the number of the upstream exhaust passage portions;

wherein the catalytic converter has a partition wall extending in a direction conforming to a direction of flow of the exhaust gas for allowing the exhaust gas from the upstream exhaust passage portions to flow through the catalytic converter without being mixed together; and wherein the partition plate has a sectional shape taken in a direction perpendicular to the direction of flow of the exhaust gas, which shape has a corrugated portion.

2. The motorcycle exhaust system as claimed in claim 1, wherein the catalytic converter is fixed to an inner peripheral surface of the exhaust passage via a bracket fixed on an outer peripheral surface of the catalytic converter, and a sealing member is interposed between the outer peripheral surface of the catalytic converter and the inner peripheral surface of the exhaust passage for avoiding a communication between the upstream or downstream exhaust passage portions outside the catalytic converter.

3. The motorcycle exhaust system as claimed in claim 1, wherein the catalytic converter is of a honeycomb structure having pores oriented in the direction of flow of the exhaust gas.

4. The motorcycle exhaust system as claimed in claim 3, further comprising a partition plate provided on an upstream side of the catalytic converter within an exhaust pipe, forming a part of the exhaust passage, so as to extend in the direction of flow of the exhaust gas for dividing the exhaust passage laterally and wherein a portion of the catalytic converter corresponding to a downstream end of the partition plate serves as the partition wall.

5. The motorcycle exhaust system as claimed in claim 1, which comprises:

four upstream exhaust pipes connected to the combustion engine of a four-cylinder;

two intermediate exhaust pipes each fluidly connected with respective downstream ends of two of the four upstream exhaust pipes;

a single downstream exhaust assemblage pipe fluidly connected with respective downstream ends of the two intermediate exhaust pipes, the single downstream exhaust assemblage pipe being provided with the catalytic converter; and a partition plate disposed at least upstream of or downstream of the catalytic converter within the single downstream exhaust assemblage pipe.

6. The motorcycle exhaust system as claimed in claim 5, wherein the catalytic converter is of a honeycomb structure having pores oriented in the direction of flow of the exhaust gas and wherein respective downstream ends of the two intermediate exhaust pipes are extended to a position immediately before the catalytic converter.

7. In a motorcycle exhaust system connected between a multi-cylinder combustion engine and muffler the improvement comprising:

a plurality of exhaust passage portions connected to the combustion engine and having a length sufficient to increase the engine output at a medium operational speed of the combustion engine;

a catalytic converter operatively connected to the plurality of exhaust passages;

an exhaust pipe, forming a part of the exhaust passage, encasing the catalytic converter and connected to the muffler, wherein the catalytic converter is positioned underneath the combustion engine for connection to the plurality of exhaust passages; and a partition plate provided on at least one of upstream and downstream sides of the catalytic converter within the exhaust pipe so as to extend in a direction of flow of exhaust gas, the partition plate dividing the exhaust passage laterally, wherein the catalytic converter has a corrugated partition wall extending in a parallel direction to a direction of flow of the exhaust gas for allowing the exhaust gas from upstream exhaust passage portions to flow through the catalytic converter without being mixed together.

8. The motorcycle exhaust system as claimed in claim 7, wherein the catalytic converter comprises a tubular body having a plurality of fine perforations and also having surfaces deposited with a catalyst and wherein the partition wall is disposed inside the tubular body.

9. The motorcycle exhaust system of claim 7 wherein the partition plate is spaced from contact with the catalytic converter by a distance equal to a thermal expansion of the partition plate to close the distance at operational temperatures of the exhaust system.

10. The motorcycle exhaust system of claim 9 wherein the partition plate is positioned upstream of the catalytic converter.

11. The motorcycle exhaust system of claim 10 further including a second partition plate positioned downstream of the catalytic converter.

12. The motorcycle exhaust system as claimed in claim 9, which comprises:

four upstream exhaust pipes connected to the combustion engine of a four-cylinder;

two intermediate exhaust pipes each fluidly connected with respective downstream ends of two of the four upstream exhaust pipes;

a single downstream exhaust assemblage pipe fluidly connected with respective downstream ends of the two intermediate exhaust pipes, the single downstream exhaust assemblage pipe being provided with the catalytic converter.

13. In a motorcycle exhaust system connected between a multi-cylinder combustion engine and muffler the improvement comprising:

a plurality of exhaust passage portions connected to the combustion engine and having a length sufficient to increase the engine output at a medium operational speed of the combustion engine;

a catalytic converter operatively connected to the plurality of exhaust passages;

an exhaust pipe, forming a part of the exhaust passage, encasing the catalytic converter and connected to the muffler, wherein the catalytic converter is positioned underneath the combustion engine for connection to the plurality of exhaust passages; and a partition plate provided on at least one of upstream and downstream sides of the catalytic converter within the exhaust pipe so as to extend in a direction of flow of exhaust gas, the partition plate dividing the exhaust passage laterally, wherein the partition plate is spaced from contact with the catalytic converter by a distance equal to a thermal expansion of the partition plate to close the distance at operational temperatures of the exhaust system.

14. The motorcycle exhaust system as claimed in claim 13, which comprises:

four upstream exhaust pipes connected to the combustion engine of a four-cylinder;

two intermediate exhaust pipes each fluidly connected with respective downstream ends of two of the four upstream exhaust pipes;

a single downstream exhaust assemblage pipe fluidly connected with respective downstream ends of the two intermediate exhaust pipes, the single downstream exhaust assemblage pipe being provided with the catalytic converter.

15. The motorcycle exhaust system as claimed in claim 13, wherein the catalytic converter comprises a tubular body having a plurality of fine perforations and also having surfaces deposited with a catalyst and wherein the partition wall is disposed inside the tubular body.

16. The motorcycle exhaust system of claim 13 wherein the partition plate is positioned upstream of the catalytic converter.

17. The motorcycle exhaust system of claim 16 further including a second partition plate positioned downstream of the catalytic converter.

* * * * *